US008836742B2

(12) United States Patent
Onishi et al.

(10) Patent No.: US 8,836,742 B2
(45) Date of Patent: Sep. 16, 2014

(54) IMAGE FORMING APPARATUS THAT STORES CHANGE DATA TO COPE WITH EVENTS THAT ARE LIKELY TO AFFECT IMAGE QUALITY

(71) Applicant: Kyocera Document Solutions Inc., Osaka (JP)

(72) Inventors: Kenichi Onishi, Osaka (JP); Okito Ogasahara, Osaka (JP); Naohiro Anan, Osaka (JP); Yasuaki Sakamoto, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/780,427

(22) Filed: Feb. 28, 2013

(65) Prior Publication Data

US 2013/0235141 A1 Sep. 12, 2013

(30) Foreign Application Priority Data

Mar. 7, 2012 (JP) ..... 2012-050566

(51) Int. Cl.

| | |
|---|---|
| ***B41J 2/435*** | (2006.01) |
| ***B41J 2/47*** | (2006.01) |
| ***G03G 15/04*** | (2006.01) |
| ***G03G 15/043*** | (2006.01) |

(52) U.S. Cl.

CPC ..... *G03G 15/04* (2013.01); *G03G 15/043* (2013.01)

USPC ..... 347/237; 347/247

(58) Field of Classification Search

USPC ..... 347/236, 237, 239, 240, 246, 247, 347/251–255

See application file for complete search history.

(56) References Cited

U.S. PATENT DOCUMENTS

| | | | | |
|---|---|---|---|---|
| 2010/0074651 | A1* | 3/2010 | Koga | 399/151 |
| 2011/0236047 | A1* | 9/2011 | Koga | 399/51 |

FOREIGN PATENT DOCUMENTS

| | | | | |
|---|---|---|---|---|
| JP | 2005-262509 | | 9/2005 | |
| JP | 2009-262344 | | 11/2009 | |
| JP | 2011-25502 | | 2/2011 | |
| JP | 2011025502 | A * | 2/2011 | B41J 2/44 |

* cited by examiner

*Primary Examiner* — Hai C Pham

(74) *Attorney, Agent, or Firm* — Gerald E. Hespos; Michael J. Porco; Matthew T. Hespos

(57) ABSTRACT

Image forming apparatus includes elements as follows. Light-amount storing section stores, in the main scanning line divided into a plurality of blocks, light amounts of a light beam irradiated on the blocks. Change-data storing section stores a plurality of change data items set in the vicinity of each of block boundaries of the plurality of blocks. The plurality of change data items are used to cope with each of a plurality of events that are likely to affect the image quality in the vicinity of the block boundary. Irradiation control section selects, out of the plurality of change data items, change data for coping with an event selected out of the plurality of events and instructs Pulse generating section to generate, in the vicinity of the block boundary, pulse signal from which analog signal indicating a change in a value represented by the selected change data is obtained.

8 Claims, 8 Drawing Sheets

IMAGE FORMING APPARATUS THAT STORES CHANGE DATA TO COPE WITH EVENTS THAT ARE LIKELY TO AFFECT IMAGE QUALITY

This application is based upon and claims the benefit of priority from Japanese Patent Application No. 2012-50566 filed in Japanese Patent Office on Mar. 7, 2012, the entire contents of which are incorporated herein by reference.

BACKGROUND

The present disclosure relates to a technique for generating a driving current for a light source, which emits a light beam for forming an electrostatic latent image, on the basis of an analog signal generated by smoothing a periodic pulse signal indicating a light amount of the light beam.

Formation of an image by an electrophotographic system includes a step of forming an electrostatic latent image of an image indicated by image data on a photosensitive drum, a step of supplying a toner to the electrostatic latent image to form a toner image, a step of transferring the toner image onto a sheet, and a step of fixing the toner image, which is transferred onto the sheet, on the sheet.

In the step of forming an electrostatic latent image, an electrostatic latent image is formed on the photosensitive drum by repeatedly reflecting a light beam, which is emitted from a light source by subjecting the light source to light emission control, with a polygon mirror and rendering a main scanning line on the rotating photosensitive drum.

When the magnitude of a driving current for the light source is fixed and the main scanning line is rendered on the photosensitive drum, a light amount (in other words, intensity) of the light beam irradiated on the photosensitive drum is different according to a position on the photosensitive drum. As a cause of the difference in the light amount of the light beam, for example, the distance between the photosensitive drum and the polygon mirror is different in the center and at both the ends of the photosensitive drum (the distance between the polygon mirror and the center of the photosensitive drum is shorter than the distance between the polygon mirror and both the ends of the photosensitive drum). An optical characteristic of a condensing lens arranged between the polygon mirror and the photosensitive drum is also a cause of the difference in the light amount of the light beam.

When the light amount of the light beam irradiated on the photosensitive drum is different according to the position on the photosensitive drum, unevenness occurs in the density of an image.

Therefore, the magnitude of the driving current for the light source is adjusted during main scanning to fix, on the photosensitive drum, the light amount of the light beam irradiated on the photosensitive drum. For example, there is proposed a technique for dividing the main scanning line into a plurality of blocks (areas), generating a pulse width modulation (PWM) signal indicating, for each of the areas, a light amount of a light beam emitted by the light source, smoothing the PWM signal, generating an analog signal having magnitude corresponding to the light amount of the light beam, and adjusting the magnitude of the driving current for the light source on the basis of the analog signal.

A duty ratio (i.e., a light amount of the light beam) of the PWM signal is switched among the areas. Therefore, image quality is sometimes affected (e.g., density unevenness of an image). In order to reduce this influence, there is proposed a technique for changing dividing positions of the areas for each main scanning line and diffusing the density unevenness of the image and a technique for finely setting output width of the PWM signal and controlling a light intensity setting value.

Control for switching the light amount of the light beam is performed in the vicinities of block boundaries. When the light amount of the light beam is suddenly changed, the image quality of regions equivalent to the vicinities of the block boundaries in the image (hereinafter, the image quality of the vicinities of the block boundaries) is sometimes deteriorated.

The sudden change of the light amount of the light beam in the vicinities of the block boundaries is one of events that are likely to affects the image quality of the vicinities of the block boundaries. As such an event, besides, there are, for example, ripples of an analog signal and a development characteristic γ. The ripples of the analog signal mean ripples that occur in the analog signal according to a period of the PWM signal when the PWM signal is smoothed to generate the analog signal. The development characteristic γ means that a change in the light amount of the light beam and a change in the density of the image are not in a proportional relation but in a logarithmic relation.

According to a state of an image to be formed, it is sometimes desired to give priority to suppression of the sudden change in the light amount of the light beam in the vicinities of the block boundaries, give priority to suppression of the influence of the ripples of the analog signal, or give priority to suppression of the influence of the development characteristic γ. It is convenient if an event to be coped with can be selected according to the state of the image to be formed out of a plurality of events that are likely to affect the image quality of the vicinities of the block boundaries.

It is an object of the present disclosure to provide an image forming apparatus that can select an event to be coped with out of a plurality of events that are likely to affect the image quality of the vicinities of the block boundaries.

SUMMARY

An image forming apparatus according to the present disclosure includes a photosensitive body, an exposing section, a pulse generating section, a smoothing section, a driving-current generating section, a light-amount storing section, a change-data storing section, and an irradiation control section. The exposing section includes a light source that emits a light beam. The exposing section scans, in a main scanning direction, the light beam emitted by the light source to render a main scanning line on the photosensitive body. The pulse generating section generates a periodic pulse signal. The smoothing section smoothes the pulse signal generated by the pulse generating section and generates an analog signal. The driving-current generating section generates a driving current for the light source on the basis of the analog signal generated by the smoothing section. The light-amount storing section stores, in the main scanning line divided into a plurality of blocks, in advance light amounts of the light beam irradiated on the blocks. The change-data storing section stores in advance a plurality of change data items set in the vicinity of each of block boundaries of the plurality of blocks. The plurality of change data items are used to cope with each of a plurality of events that are likely to affect the image quality in the vicinity of the block boundary. The plurality of change data items respectively represent changes in a value of the analog signal at the time when the blocks on which the light beam is irradiated are switched in the vicinity of the block boundary. The irradiation control section selects, out of the plurality of change data items stored in the change-data storing section, change data for coping with an event selected out of the plurality of events and instructs the pulse generating section to generate, (a) in the vicinity of the block boundary, the pulse signal from which the analog signal indicating a change in a value represented by the selected change data is obtained and (b) in the blocks, the pulse signal indicating the light amounts of the light beam irradiated on the blocks stored in the light-amount storing section.

DETAILED DESCRIPTION

Figure 1:
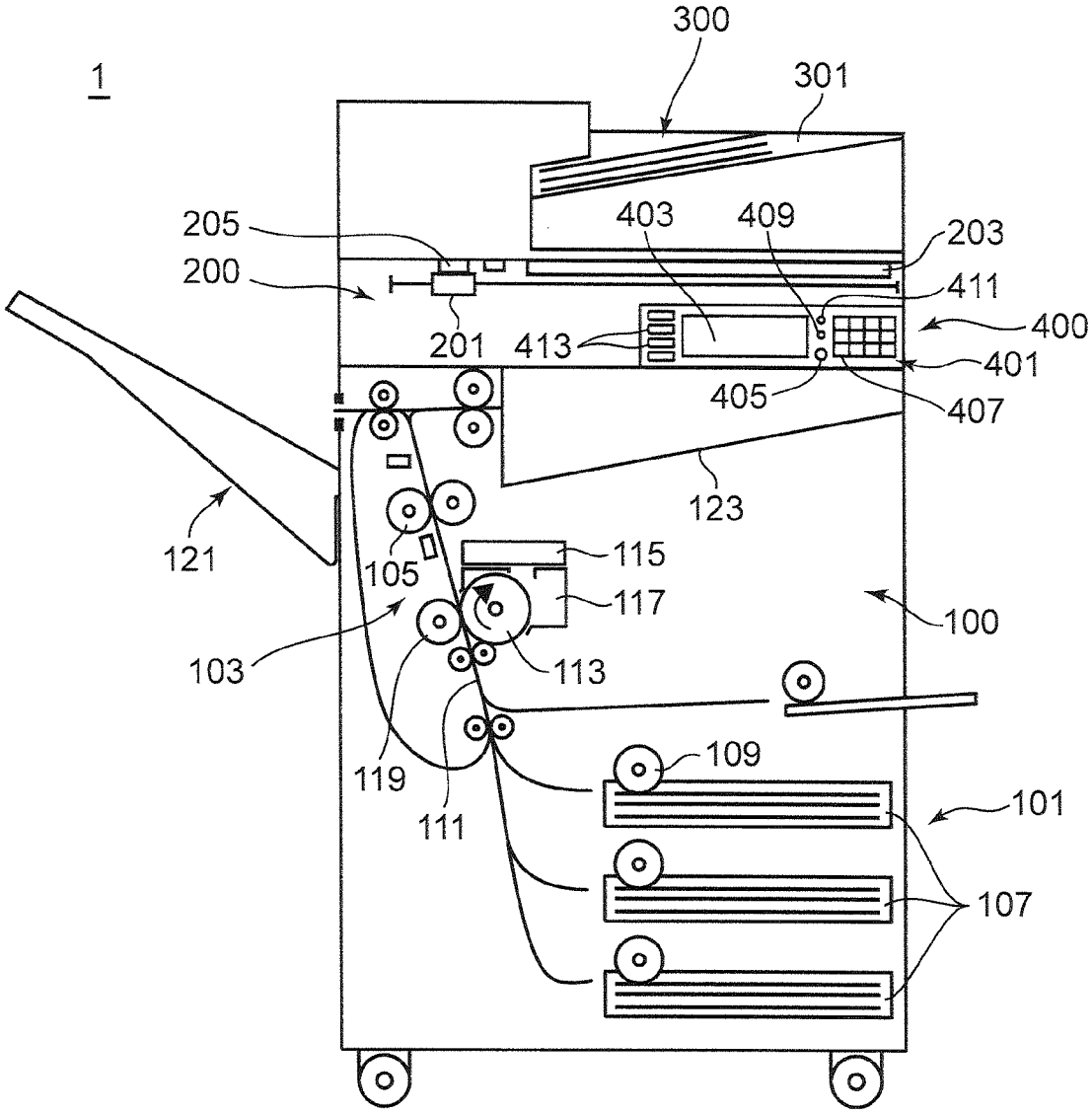
FIG. 1 is a diagram showing a schematic internal configuration of an image forming apparatus according to an embodiment of the present disclosure.

An embodiment of the present disclosure is explained below with reference to the drawings. FIG. 1 is a diagram showing a schematic internal configuration of an image forming apparatus 1 according to an embodiment of the present disclosure. The image forming apparatus 1 can be applied to, for example, a digital multifunction peripheral having functions of a copying machine, a printer, a scanner, and a facsimile. The image forming apparatus 1 includes an apparatus main body 100, a document reading section 200 arranged on the apparatus main body 100, a document feeding section 300 arranged on the document reading section 200, and an operation section 400 arranged on the upper front surface of the apparatus main body 100.

The document feeding section 300 functions as an auto document feeder. The document feeding section 300 can continuously feed a plurality of original documents placed on a document placing section 301 to the document reading section 200.

The document reading section 200 includes a carriage 201 mounted with an exposure lamp and the like, a document table 203 configured by a transparent member such as glass, a not-shown charge coupled device (CCD) sensor, and a document reading slit 205. When reading an original document placed on the document table 203, the document reading section 200 reads the original document with the CCD sensor while moving the carriage 201 in the longitudinal direction of the document table 203. On the other hand, when reading an original document fed from the document feeding section 300, the document reading section 200 moves the carriage 201 to a position opposed to the document reading slit 205 and reads the original document, which is fed from the document feeding section 300, with the CCD sensor through the document reading slit 205. The CCD sensor outputs the read original document as image data.

The apparatus main body 100 includes a sheet storing section 101, an image forming section 103, and a fixing section 105. The sheet storing section 101 is arranged in the bottom section of the apparatus main body 100. The sheet storing section 101 includes sheet trays 107 in which bundles of sheets can be stored. A sheet at the top in the bundle of sheets stored in the sheet tray 107 is delivered to a sheet conveying path 111 by the driving of a pickup roller 109. The sheet is conveyed to the image forming section 103 through the sheet conveying path 111.

The image forming section 103 forms a toner image on the sheet conveyed to the image forming section 103. The image forming section 103 includes a photosensitive drum 113, an exposing section 115, a developing section 117, and a transfer section 119. The exposing section 115 generates light modulated according to image data (image data output from the document reading section 200, image data transmitted from a personal computer, image data received by facsimile, etc.) and irradiates the light on the circumferential surface of the uniformly-charged photosensitive drum 113. Consequently, an electrostatic latent image corresponding to the image data is formed on the circumferential surface of the photosensitive drum 113. A toner is supplied from the developing section 117 to the circumferential surface of the photosensitive drum 113 in this state, whereby a toner image corresponding to the image data is formed on the circumferential surface. The toner image is transferred onto the sheet conveyed from the sheet storing section 101 by the transfer section 119.

The sheet having the toner image transferred thereon is sent to the fixing section 105. The fixing section 105 applies heat and pressure to the toner image and the sheet to fix the toner image on the sheet. The sheet is discharged to a stack tray 121 or a paper discharge tray 123.

The operation section 400 includes an operation key section 401 and a display section 403. The display section 403 has a touch panel function. A screen including soft keys is displayed on the display section 403. A user performs setting and the like necessary for execution of functions such as copying by operating the soft keys while looking at the screen.

Operation keys consisting of hard keys are provided in the operation key section 401. Specifically, a start key 405, a ten key 407, a stop key 409, a reset key 411, function switching keys 413 for switching a copying machine, a printer, a scanner, and a facsimile, and the like are provided.

The start key 405 is a key for starting operations such as copying and facsimile transmission. The ten key 407 is a key for inputting numbers such as the number of copies and a facsimile number. The stop key 409 is a key for stopping a copy operation and the like halfway. The reset key 411 is a key for resetting set content to an initial setting state.

The function switching keys 413 include a copy key and a transmission key. The function switching keys 413 are keys for switching a copy function, a transmission function, and the like. If the copy key is operated, an initial screen for copying is displayed on the display section 403. If the transmission key is operated, an initial screen for facsimile transmission and mail transmission is displayed on the display section 403.

Figure 2:
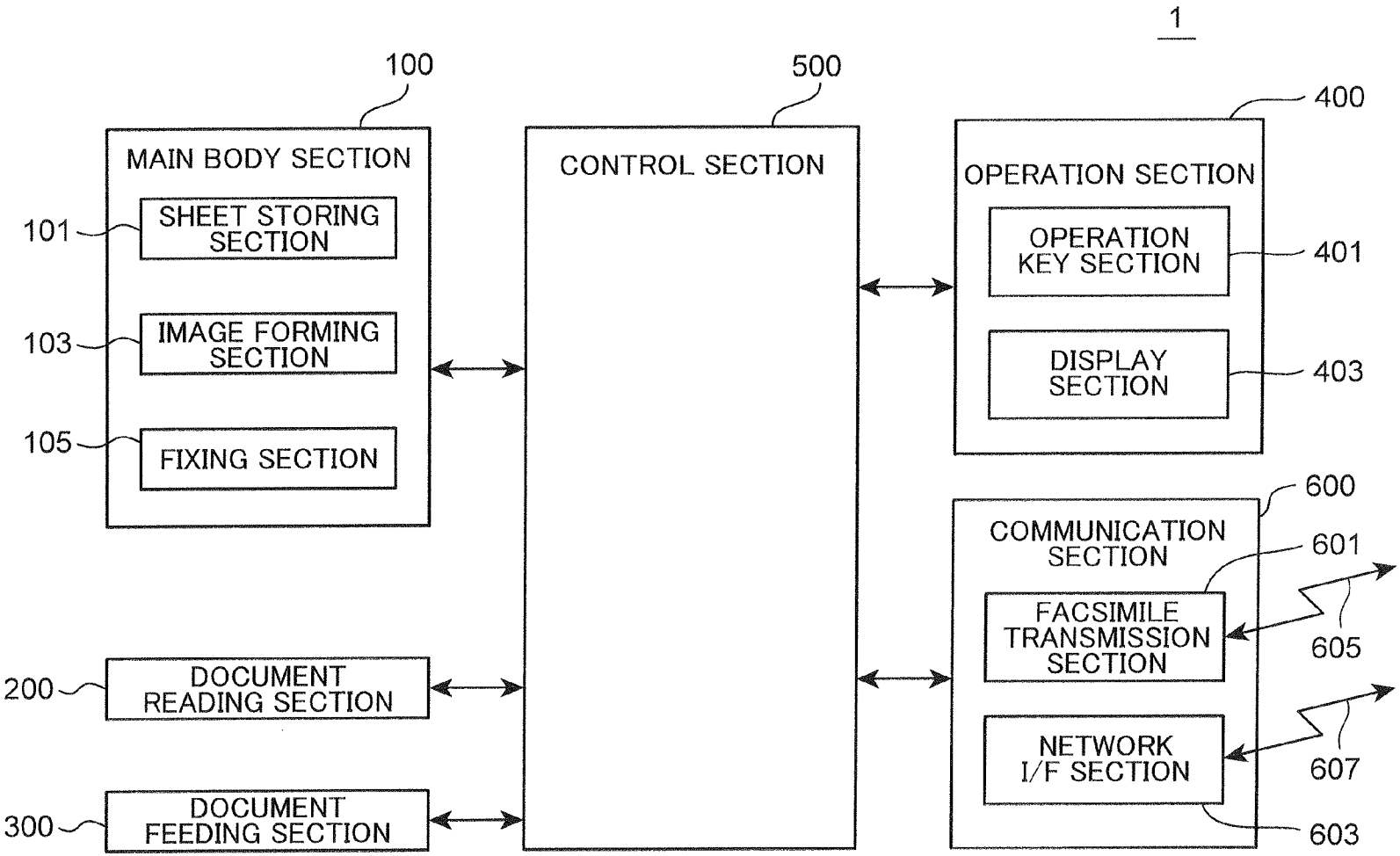
FIG. 2 is a block diagram showing the configuration of the image forming apparatus shown in FIG. 1.

FIG. 2 is a block diagram showing the configuration of the image forming apparatus 1 shown in FIG. 1. The image forming apparatus 1 has a configuration in which the apparatus main body 100, the document reading section 200, the document feeding section 300, the operation section 400, a control section 500, and a communication section 600 are connected to one another by a bus. Since the apparatus main body 100, the document reading section 200, the document feeding section 300, and the operation section 400 are explained above, explanation thereof is omitted.

The control section 500 includes a central processing unit (CPU), a read only memory (ROM), a random access memory (RAM), and an image memory. The CPU executes, on the components of the image forming apparatus 1 such as the apparatus main body 100, control necessary for operating the image forming apparatus 1. The ROM has stored therein software necessary for the control of the operation of the image forming apparatus 1. The RAM is used for, for example, temporary storage of data generated during execution of the software and storage of application software. The image memory temporarily stores image data (image data output from the document reading section 200, image data transmitted from a personal computer, image data received by facsimile, etc.).

The communication section 600 includes a facsimile communication section 601 and a network I/F section 603. The facsimile communication section 601 includes a network control unit (NCU) configured to control connection of a telephone line to a partner facsimile and a modulating and demodulating circuit configured to modulate and demodulate a signal for facsimile communication. The facsimile communication section 601 is connected to a telephone line 605.

The network I/F section 603 is connected to a local area network (LAN) 607. The network I/F section 603 is a communication interface circuit for executing communication with a terminal apparatus such as a personal computer connected to the LAN 607.

Figure 3:
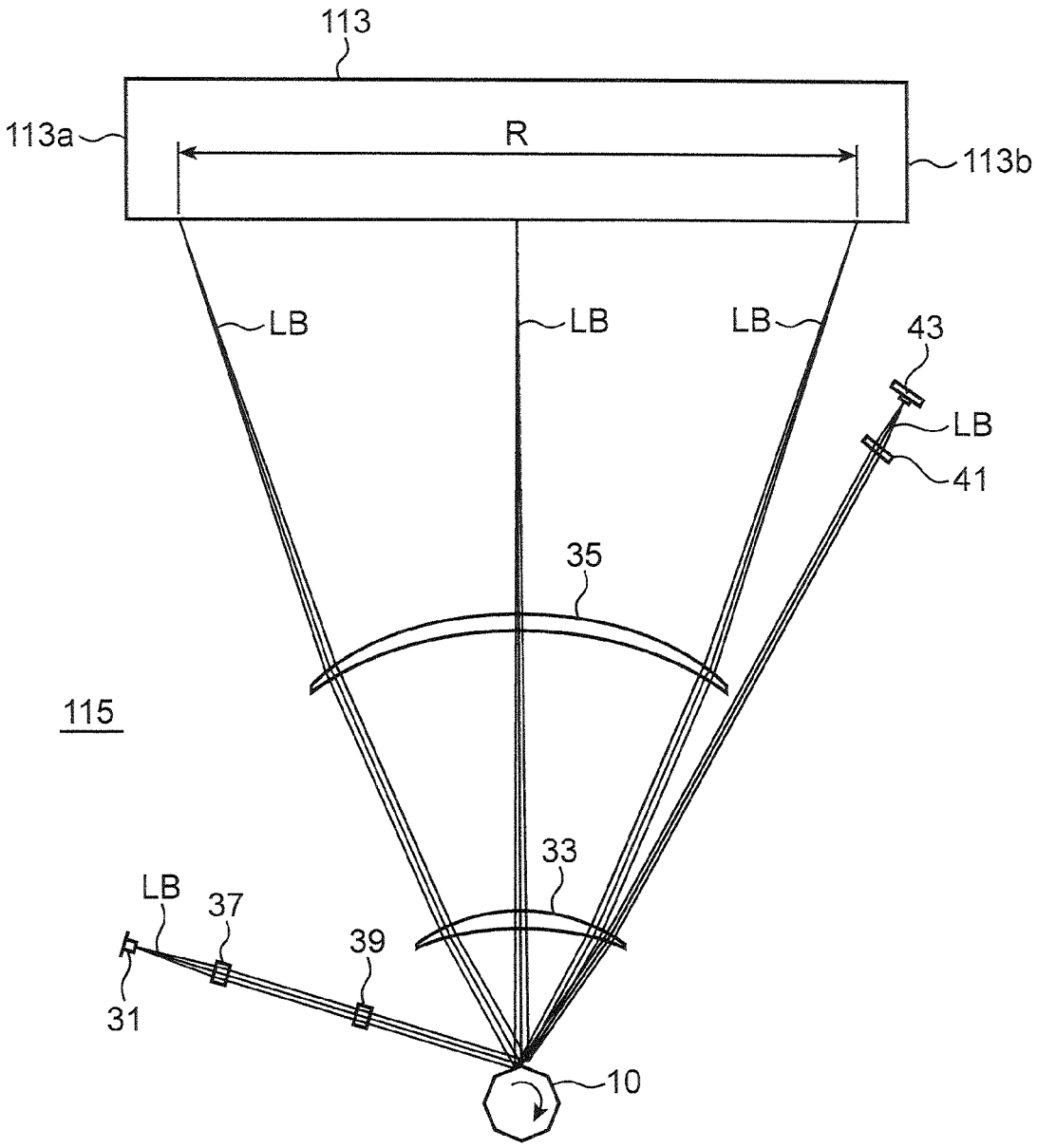
FIG. 3 is a diagram showing an arrangement relation of optical components that configure an exposing section included in the image forming apparatus shown in FIG. 1.

The exposing section 115 is explained in detail. FIG. 3 is a diagram showing an arrangement relation of optical components included in the exposing section 115. The exposing section 115 includes a light source 31, a polygon mirror 10, and two scanning lenses 33 and 35. The light source 31 is, for example, a laser diode. The light source 31 emits a light beam LB.

A collimator lens 37 and a cylindrical lens 39 are arranged on an optical path between the light source 31 and the polygon mirror 10. The collimator lens 37 changes the light beam LB emitted from the light source 31 to parallel rays. The cylindrical lens 39 linearly condenses the light beam LB changed to the parallel rays. The linearly condensed light beam LB is made incident on the polygon mirror 10.

The scanning lens 33 and the scanning lens 35 are arranged on an optical path between the polygon mirror 10 and the photosensitive drum 113. The light beam LB made incident on a deflecting surface of the polygon mirror 10 is reflected and deflected on the deflecting surface and focused on the photosensitive drum 113 by the scanning lenses 33 and 35. That is, the light beam LB is scanned on the photosensitive drum 113, whereby an electrostatic latent image is formed on the photosensitive drum 113.

The exposing section 115 further includes a beam detect (BD) lens 41 and a BD sensor 43. The light beam LB scans the photosensitive drum 113 from one side portion 113*a* to the other side portion 113*b* of the photosensitive drum 113. The light beam LB exceeding an effective scanning range R is condensed by the BD lens 41 and received by the BD sensor 43. Upon receiving the light beam LB, the BD sensor 43 generates a BD signal set as a reference for starting scanning (main scanning) on the photosensitive drum 113.

As explained above, the exposing section 115 includes the light source 31 configured to emit the light beam LB. The exposing section 115 scans the light beam LB emitted by the light source 31 in the main scanning direction to render a main scanning line on the photosensitive drum 113 (an example of a photosensitive body).

Figure 4:
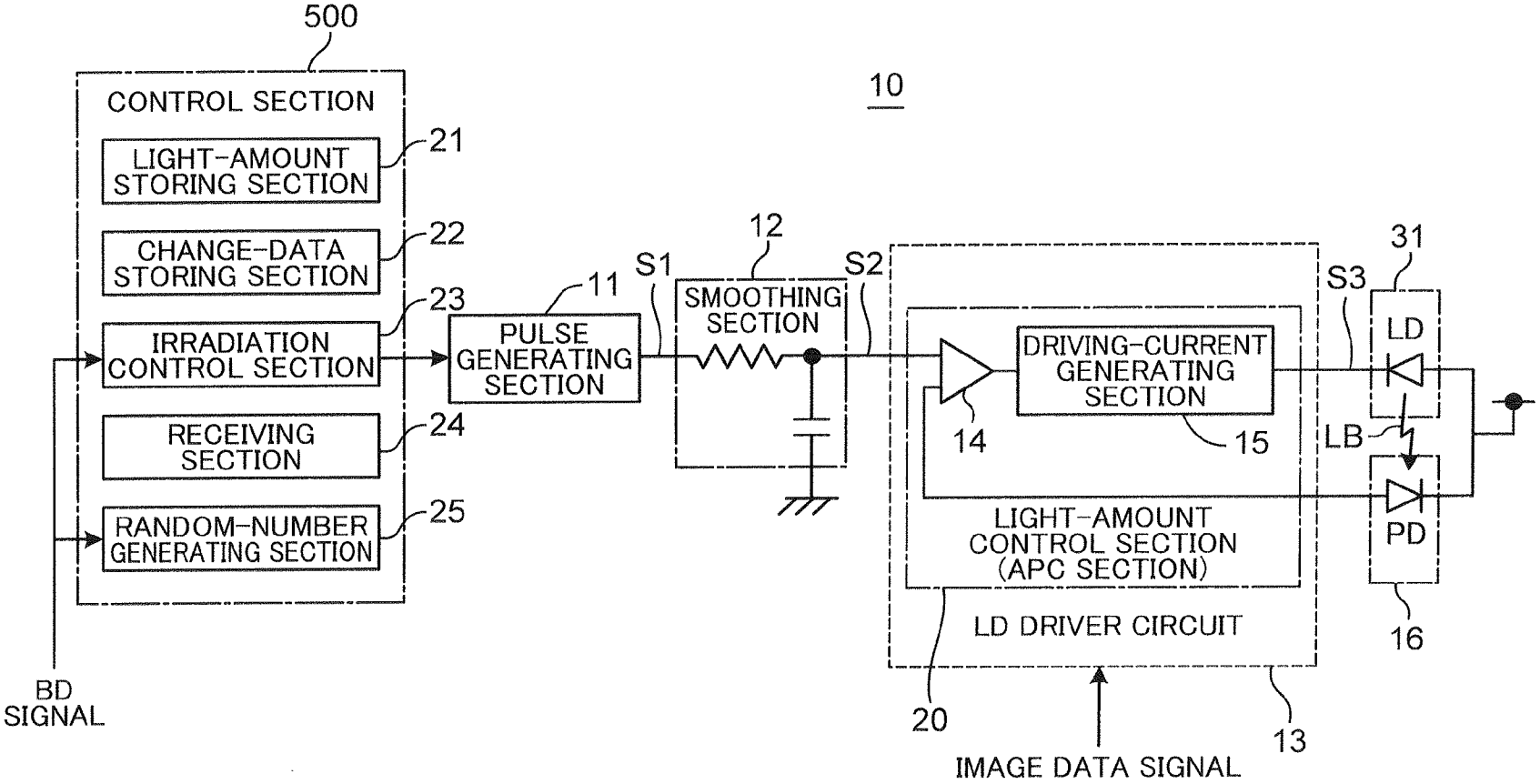
FIG. 4 is a block diagram showing the configuration of a driving current generating device that generates a driving current for a light source.

In this embodiment, a driving current for the light source 31 is generated on the basis of a pulse signal. FIG. 4 is a block diagram showing the configuration of the driving current generating device 10 configured to generate a driving current S3 for the light source 31. The driving current generating device 10 includes a pulse generating section 11, a smoothing section 12, an LD driver circuit 13, a light-amount storing section 21, a change-data storing section 22, and an irradiation control section 23.

The pulse generating section 11 generates a periodic pulse signal S1. The pulse generating section 11 is realized by, for example, an application specific integrated circuit (ASIC) or a field programmable gate array (FPGA). As the periodic pulse signal S1, for example, a PWM signal or a pulse density modulation (PDM) signal can be used. The PDM signal is a signal in which density (interval) of output of a pulse having fixed pulse width is variable. In this embodiment, the PWM signal is explained as an example of the pulse signal S1 generated by the pulse generating section 11. A light amount of the light beam LB emitted by the light source 31 is indicated using a duty ratio of the PWM signal.

The smoothing section 12 is configured by a low-pass filter consisting of a CR filter. The smoothing section 12 smoothes the pulse signal S1 generated by the pulse generating section 11 and generates an analog voltage S2 (an analog signal). The analog voltage S2 indicates a light amount of the light beam LB emitted by the light source 31.

The analog voltage S2 is sent to the LD driver circuit 13. An image data signal indicating an image to be printed on a sheet is input to the LD driver circuit 13. The LD driver circuit 13 executes, using the analog voltage S2 and the image data signal, control for generating the driving current S3 for the light source 31 and lighting control for the light source 31.

The LD driver circuit 13 includes a comparing section and a driving-current generating section 15. The analog voltage S2 generated by the smoothing section 12 is input to one input section of the comparing section 14 and sent to the driving-current generating section 15. The driving-current generating section 15 generates the driving current S3 for the light source 31 using the analog voltage S2.

The light source 31 is turned on by the driving current S3 to emit the light beam LB. Besides being irradiated on the photosensitive drum 113, the light beam LB is received by a light receiving section 16 consisting of a photodiode. A signal output from the light receiving section 16 is input to the other input section of the comparing section 14.

An anode of the laser diode, which is the light source 31, is connected to a cathode of the photodiode, which is the light receiving section 16. The anode and the cathode are connected to a power supply.

A light-amount control section 20 (an APC section) is configured by the comparing section 14 and the driving-current generating section 15. The light-amount control section 20 subjects the magnitude of the driving current S3 to automatic control (APC) in an APC period to match a light amount of the light beam LB emitted by the light source 31 in an effective image period with a light amount of the light beam LB indicated by the pulse signal S1 generated by the pulse generating section 11. The effective image period means a period in which the light beam LB is scanned in the effective scanning range R on the photosensitive drum 113 and the main scanning line rendered on the photosensitive drum 113 is treated as an effective image.

The light-amount storing section 21, the change-data storing section 22, the irradiation control section 23, a receiving section 24, and a random-number generating section 25 are functional blocks executed by the control section 500.

Figure 5:
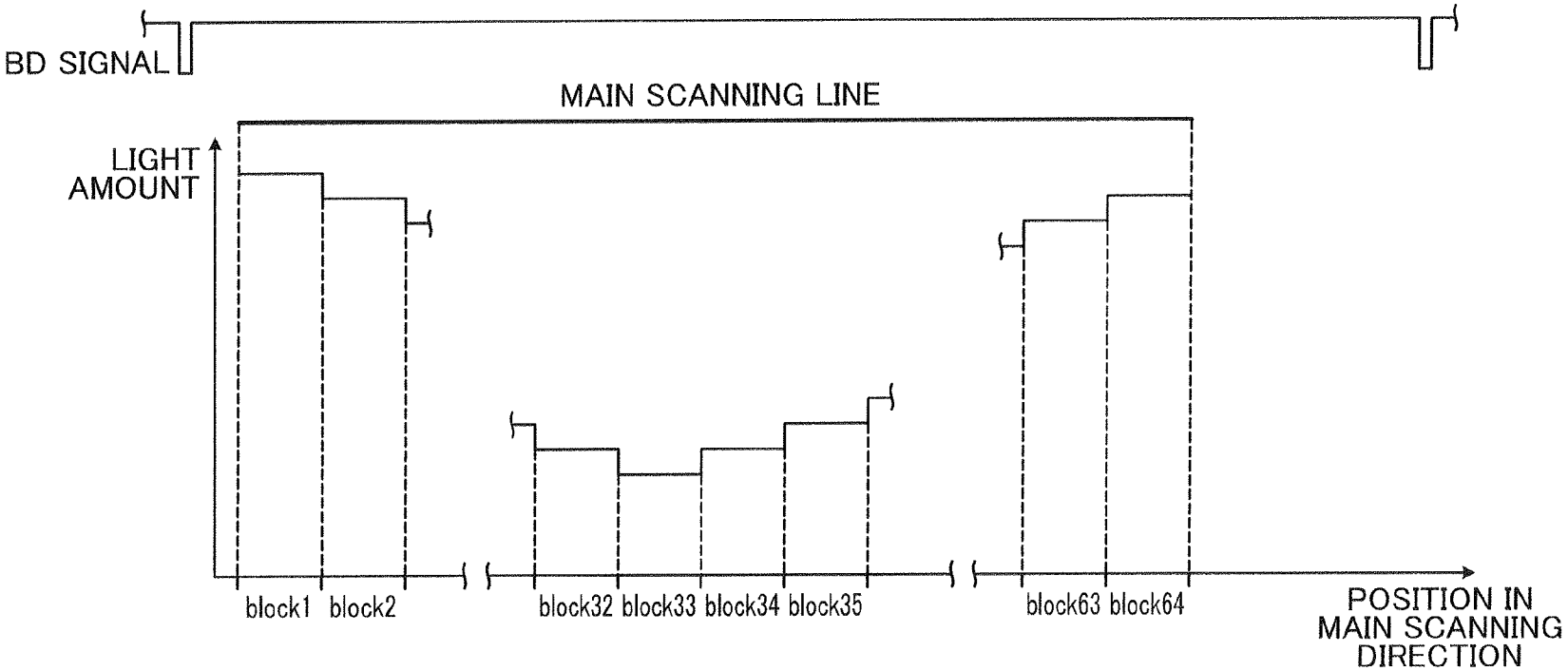
FIG. 5 is a diagram showing an example of a relation between light amounts and blocks.

The light-amount storing section 21 stores, in the main scanning line divided into a plurality of blocks, in advance light amounts of the light beam LB irradiated on the blocks. FIG. 5 is a diagram showing an example of a relation between the light amounts and the blocks. The ordinate indicates a light amount and the abscissa indicates a position in the main scanning direction. In an example explained below, the number of blocks is sixty-four.

Sixty-four blocks are arranged along the main scanning direction in order from a first block (a block 1). A light amount of the light beam LB is set for each of the blocks. Light amounts are reduced stepwise from the first block to a thirty-third block (a block 33) and are increased stepwise from the thirty-third block to a sixty-fourth block (a block 64). In other words, the light amounts are reduced stepwise from the one side portion 113*a* of the photosensitive drum 113 shown in FIG. 3 to the center and increased stepwise from the center to the other side portion 113*b*.

In a form explained above, the light amount is reduced stepwise from the first block to the thirty-third block. However, a form is also possible in which the light amount is increased once in a halfway block and reduced again in the next block. Similarly, in the form explained above, the light amount is increased stepwise from the thirty-third block to the sixty-fourth block. However, a form is also possible in which the light amount is once reduced in a halfway block and increased again in the next block.

Referring back to FIG. 4, the change-data storing section 22 stores in advance a plurality of change data items set in the vicinity of each of block boundaries of the plurality of blocks. If the number of blocks is sixty-four, a plurality of change data items set for the vicinity of a block boundary of first and second blocks, a plurality of change data items set for the vicinity of a block boundary of second and third blocks, . . . , and a plurality of change data items set for the vicinity of a block boundary of sixty-third and sixty-fourth blocks are stored.

The plurality of change data items are used to cope with each of a plurality of events (e.g., a sudden change in a light amount of the light beam LB, ripples of the analog voltage S2, and a development characteristic γ) that are likely to affect the image quality of the vicinity of the block boundary. The plurality of change data items are data respectively representing changes in a value of the analog voltage S2 at the time when the blocks on which the light beam LB is irradiated are switched in the vicinity of the block boundary. The plurality of change data items can be considered data respectively representing changes in a value of the analog voltage S2 at the time when the light beam LB is irradiated on the vicinity of the block boundary.

Figure 6:
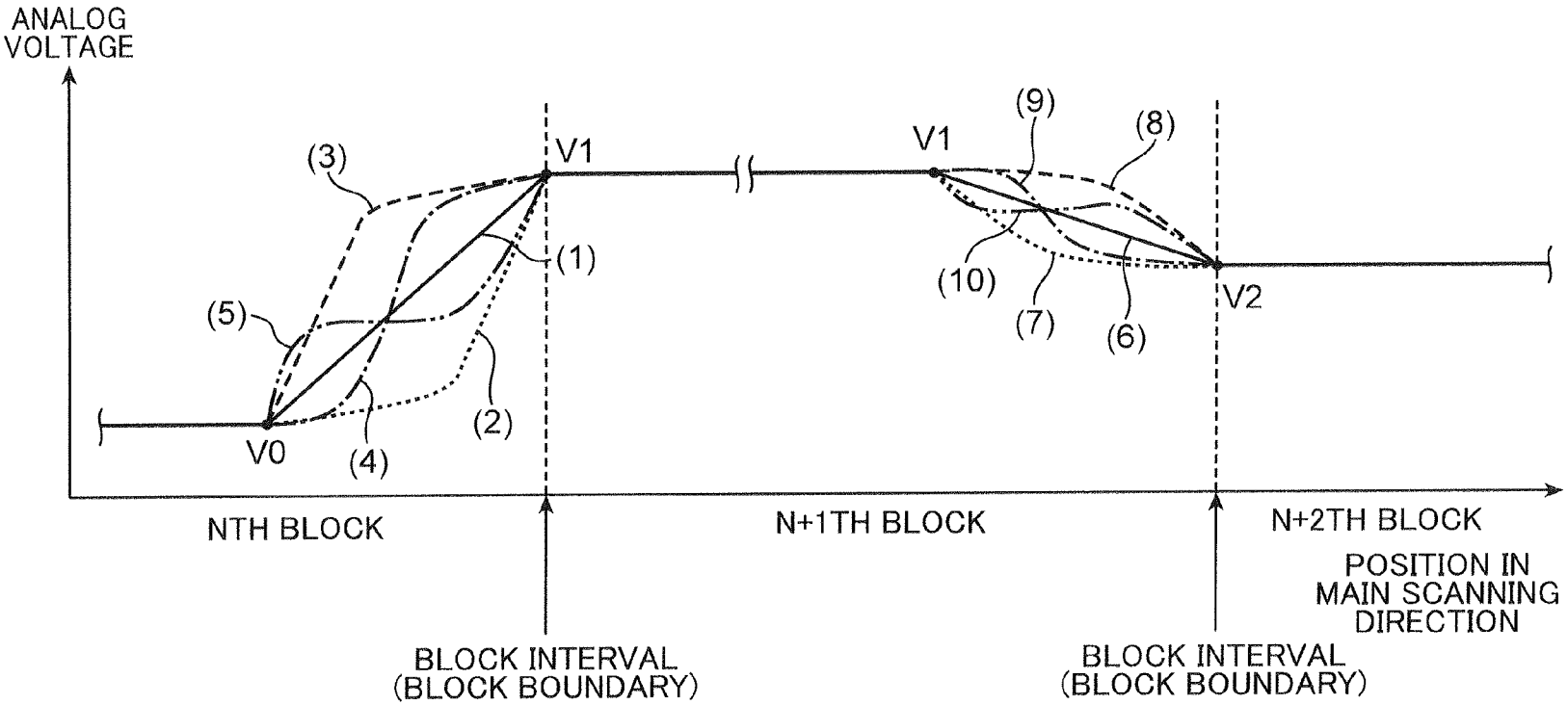
FIG. 6 is a graph showing an example of an analog voltage generated when a light beam is irradiated on Nth, N+1th, and N+2th blocks.

The change data is explained in detail. FIG. 6 is a graph showing an example of the analog voltage S2 generated when the light beam LB is irradiated on Nth, N+1th, and N+2th blocks. The ordinate indicates the analog voltage S2 and the abscissa indicates a position in the main scanning direction. A change in the analog voltage S2 corresponds to a change in a light amount of the light beam LB. The ordinate can be rephrased as a change in the light amount of the light beam LB. A block interval in FIG. 6 means a block boundary. The vicinity of the block boundary can be referred to as the vicinity of a block interval as well.

A target value of the analog voltage S2 at the time when the light beam LB is irradiated on the Nth block is represented as V0, a target value of the analog voltage S2 at the time when the light beam LB is irradiated on the N+1th block is represented as V1, and a target value of the analog voltage S2 at the time when the light beam LB is irradiated on the N+2th block is represented as V2. A relation among the target values is V0<V2<V1.

The change-data storing section 22 stores five change data (1) to (5) set in the vicinity of the block boundary of the Nth and N+1th blocks in order to increase the target value V0 in the Nth block to the target value V1 in the N+1th block. According to the change data (1), a gradient of the graph indicating a change in the analog voltage S2 is fixed. According to the change data (2), a gradient of the graph is small at first and increases halfway. According to the change data (3), a gradient of the graph is large at first and decreases halfway. According to the change data (4), a gradient of the graph is small at first, increases halfway, and decreases again. According to the change data (5), a gradient of the graph is large at first, decreases halfway, and increases again.

The gradients of the graph can be realized by adjusting a duty ratio of the PWM signal, which is the pulse signal S1. For example, in the change data (2), the duty ratio of the PWM signal is set small first and increased halfway.

In the same position in the main scanning direction, a value obtained by adding up a value of the change data (2) and a value of the change data (3) and dividing an added-up value by 2 is a value of the change data (1). Similarly, in the same position in the main scanning direction, a value obtained by adding up a value of the change data (4) and a value of the change data (5) and dividing an added-up data by 2 is a value of the change data (1).

The change-data storing section 22 stores five change data (6) to (10) set in the vicinity of the block boundary of the N+1th and N+2th blocks in order to increase the target value V1 in the N+1th block to the target value V2 in the N+2th block.

According to the change data (6), a gradient of the graph indicating a change in the analog voltage S2 is fixed. According to the change data (7), a gradient of the graph is large at first and decreases halfway. According to the change data (8), a gradient of the graph is small at first and increases halfway. According to the change data (9), a gradient of the graph is small at first, increases halfway, and decreases again. According to the change data (10), a gradient of the graph is large at first, decreases halfway, and increases again.

In the same position in the main scanning direction, a value obtained by adding up a value of the change data (7) and a value of the change data (8) and dividing an added-up value by 2 is a value of the change data (6). Similarly, in the same position in the main scanning direction, a value obtained by adding up a value of the change data (9) and a value of the change data (10) and dividing an added-up data by 2 is a value of the change data (6).

As a gradient of the graph increases, a change amount of a light amount of the light beam LB increases. For example, if priority is given to coping with a sudden change of the light amount of the light beam LB in the vicinity of the block boundary, the irradiation control section 23 selects change data with a fixed gradient of the graph out of the five change data. Therefore, the irradiation control section 23 selects the change data (1) in the vicinity of the block boundary of the Nth and N+1th blocks and selects the change data (6) in the vicinity of the block boundary of the N+1th and N+2th blocks. This is because all the graphs by the change data (2) to (5) have places where the gradients are larger than the gradient of the graph by the change data (1) and, similarly, all the graphs by the change data (7) to (10) have places where the gradients are larger than the gradient of the graph by the change data (6).

If priority is given to coping with the development characteristic γ, when a gradient of a graph of the development characteristic γ is, for example, the same as the gradient of the graph of the change data (4) in the vicinity of the block boundary of the Nth and N+1th blocks, the irradiation control section 23 selects the change data (5) out of the five change data. Consequently, it is possible to proportionate a change in a light amount and a density change in an image in the vicinity of the block boundary of the Nth and N+1th blocks. When the gradient of the graph of the development characteristic γ is, for example, the same as the gradient of the graph of the change data (9) in the vicinity of the block boundary of the N+1th and N+2th blocks, the irradiation control section 23 selects the change data (10) out of the five change data. Consequently, it is possible to proportionate a change in a light amount and a density change in an image in the vicinity of the block boundary of the N+1th and N+2th blocks. In this case, the change data (5) and the change data (10) are change data for correction for proportionating a change in a light amount of the light beam LB and a change in the density of an image in the vicinity of the block boundary.

According to the change data (3) and the change data (8), it is possible to reduce a gradient of the graph in the N+1th block. When it is desired to reduce a change in a light amount as much as possible in the N+1th block because of some reason, the irradiation control section 23 selects the change data (3) in the vicinity of the block boundary of the Nth and N+1th blocks and selects the change data (8) in the vicinity of the block boundary of the N+1th and N+2th blocks.

If priority is given to coping with ripples of the analog voltage S2, for each main scanning line, the irradiation control section 23 selects the change data (1) to (5) at random in the vicinity of the block boundary of the Nth and N+1th blocks and selects the change data (6) to (10) at random in the vicinity of the block boundary of the N+1th and N+2th blocks. Consequently, it is possible to reduce the influence of the ripples of the analog voltage S2. This is explained below.

Figure 7:
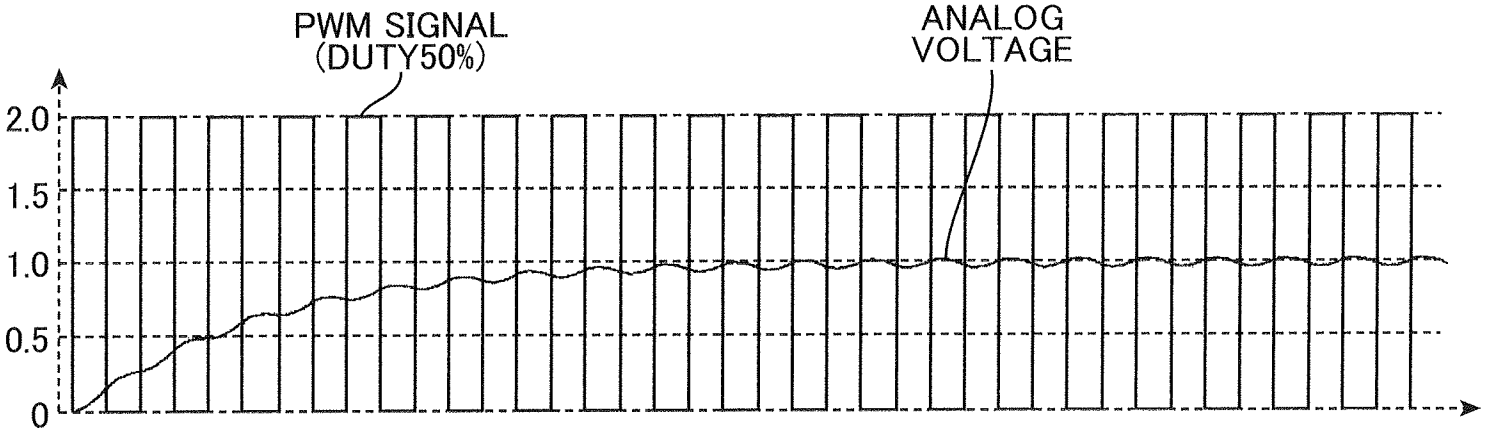
FIG. 7 is a graph representing a relation between a PWM signal having a duty ratio of 50% and an analog signal.

First, a relation between the PWM signal, which is the pulse signal S1, generated by the pulse generating section 11 and the analog voltage S2 generated by the smoothing section 12 is explained. FIG. 7 is a graph representing the relation. The abscissa of the graph indicates time and the ordinate of the graph indicates a value of the analog voltage S2. A duty ratio of the PWM signal generated by the pulse generating section 11 is set to 50 percent.

When the pulse generating section 11 starts the generation of the PWM signal, the analog voltage S2 gradually increases from 0 V and reaches 1.0 V. Ripples occur in the analog voltage S2 according to a period of the PWM signal.

Figure 8:
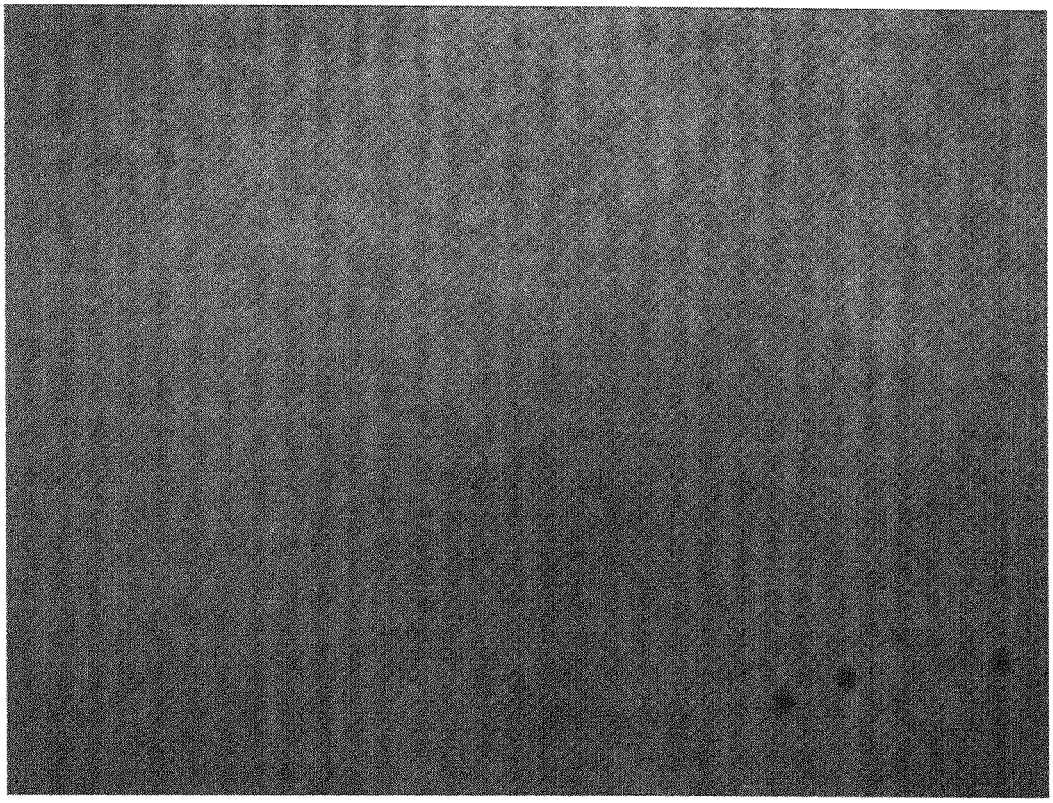
FIG. 8 is an enlarged diagram of an image in which streak-like noise extending along a sub-scanning direction appears.

The inventor has found that, when main scanning lines are rendered at the same frequency of the pulse signal S1 (the PWM signal), streak-like noise extending along the sub-scanning direction sometimes appears in an image because of the influence of the ripples that occur in the analog voltage S2. FIG. 8 is an enlarged diagram of the image in which the streak-like noise extending along the sub-scanning direction appears. Longitudinal streaks are noise. When the pulse signal S1 having the same frequency is used, a pattern of a change in the pulse signal S1 is the same. Therefore, the positions in the main scanning direction of the ripples are aligned on the main scanning lines. As a result, the ripples are aligned along the sub-scanning direction. This is considered to be a reason why the noise occurs.

In the vicinity of the block boundary, likewise, when the same change data is selected for rendering of the main scanning lines, the noise is likely to occur. Therefore, in the rendering of the main scanning lines, if the five change data are selected at random, it is possible to prevent the positions in the main scanning direction of the ripples that occur in the analog voltage S2 from being aligned in the vicinity of the block boundary of the main scanning lines. Therefore, since it is possible to prevent the ripples from being aligned along the sub-scanning direction in the vicinity of the block boundary, it is possible to prevent streak-like noise extending along the sub-scanning direction from appearing in an image in the vicinity of the block boundary, arising from ripple effects.

Referring back to FIG. 4, the irradiation control section 23 selects, out of the plurality of change data items stored in the change-data storing section 22, change data for coping with an event selected out of the plurality of events. The irradiation control section 23 instructs the pulse generating section 11 to generate, (a) in the vicinity of the block boundary, the pulse signal S1 from which the analog voltage S2 indicating a change in a value represented by the selected change data is obtained and (b) in the blocks, the pulse signal S1 indicating the light amounts of the light beam LB irradiated on the blocks stored in the light-amount storing section 21.

For example, when the event selected out of the plurality of events is ripples that occur in the analog voltage S2, in rendering of the respective main scanning lines, the irradiation control section 23 selects, at random, any one of the plurality of change data items stored in the change-data storing section 22 and instructs the pulse generating section 11 to generate the pulse signal S1 (the pulse signal S1 in (a)) from which the analog voltage S2 indicating a change in a value represented by the selected change data is obtained. For the random selection of the plurality of change data items, the random-number generating section 25 is used.

A BD signal is input to the random-number generating section 25. The random-number generating section 25 generates a random number every time the BD signal is input and sends the generated random number to the irradiation control section 23. Any one of the five change data stored in the change-data storing section 22 is allocated to the random number. The irradiation control section 23 selects, out of the five change data stored in the change-data storing section 22, change data to which the random number is allocated. In this way, in the rendering of the main scanning lines, the irradiation control section 23 selects, at random, the five change data stored in the change-data storing section 22.

For example, when the event selected out of the plurality of events is the development characteristic γ indicating a relation between a change in a light amount of the light beam LB and a change in the density of an image, the irradiation control section 23 selects change data for correction among the plurality of change data items stored in the change-data storing section 22 and instructs the pulse generating section 11 to generate the pulse signal S1 (the pulse signal S1 in (a)) from which the analog voltage S2 indicating a change in a value represented by the selected change data for correction is obtained.

When the operation section 400 is operated and an input for selecting an event to be coped with out of the plurality of events is performed, the receiving section 24 receives the input. The irradiation control section 23 selects, out of the plurality of change data items stored in the change-data storing section 22, change data for coping with the event, the selection of which is received by the receiving section 24. The irradiation control section 23 instructs the pulse generating section 11 to generate the pulse signal S1 (the pulse signal S1 in (a)) from which the analog voltage S2 indicating a change in a value represented by the change data is obtained.

As shown in FIG. 6, the analog voltage is set to reach a target value allocated to the next block at a point when the block on which the light beam LB is irradiated is switched to the next block. For example, the analog voltage is set to reach the target value V1 allocated to the N+1th block at a point when the Nth block is switched to the N+1th block. That is, the irradiation control section 23 instructs the pulse generating section 11 to switch the pulse signal S1 in (b) to the pulse signal S1 in (a) before the block on which the light beam LB is irradiated is switched to the next block in each block of the plurality of blocks in order to cause a light amount of the light beam LB irradiated on the block to reach a light amount of the light beam LB irradiated on the next block at a point when the block on which the light beam LB is irradiated is switched to the next block.

Main effects of this embodiment are explained. In the image forming apparatus 1 according to this embodiment, concerning the plurality of change data items used for coping with each of the plurality of events (e.g., a sudden change in a light amount of a light beam, ripples of an analog signal, and the development characteristic γ) that are likely to affect the image quality of the vicinity of the block boundary, the plurality of change data items set in the vicinities of the block boundaries are stored in the change-data storing section 22 in advance. The change data is data representing a change in a value of the analog voltage S2 at the time when the light beam LB is irradiated on the vicinity of the block boundary. The change in the analog voltage S2 corresponds to a change in a light amount of the light beam LB.

In the image forming apparatus 1 according to this embodiment, change data for coping with an event selected out of the plurality of events is selected out of the plurality of change data items. A serviceperson or a user can operate the operation section 400 of the image forming apparatus 1 and select change data. The image forming apparatus 1 can automatically select change data. For example, if priority is given to coping with a sudden change in a light amount of the light beam LB, change data with a fixed gradient of a graph indicating a change in the light amount of the light beam LB in the vicinity of the block boundary is selected. If priority is given to coping with ripples of the analog voltage S2, the plurality of change data items are selected at random in every rendering of a main scanning line.

In the image forming apparatus 1 according to this embodiment, the pulse signal S1 (the pulse signal S1 in (a)) from which the analog voltage S2 indicating a change in a value represented by the selected change data is generated in the vicinity of the block boundary. For example, if the pulse signal S1 is the PWM signal, the analog voltage S2 indicating the change in the value represented by the selected change data is generated by adjusting a duty ratio of the PWM signal. For example, when a gradient of a graph indicating the analog voltage S2 (in other words, the light amount of the light beam LB) is set small at first and increased halfway, the duty ratio of the PWM signal is set small first and increased halfway.

Consequently, with the image forming apparatus 1 according to this embodiment, it is possible to select an event to be coped with out of the plurality of events that are likely to affect the image quality of the vicinity of the block boundary.

The image forming apparatus 1 according to this embodiment includes the receiving section 24 configured to receive an input of operation for selecting an event to be coped with out of the plurality of events. The irradiation control section 23 selects, out of the plurality of change data items, change data for coping with the event, the selection of which is received by the receiving section 24. The irradiation control section 23 instructs the pulse generating section 11 to generate, in the vicinity of the block boundary, the pulse signal S1 (the pulse signal S1 in (a)) from which the analog voltage S2 indicating a change in a value represented by the selected change data is obtained. Therefore, the serviceperson or the user can select an event to be coped with out of the plurality of events on the basis of an image printed by the image forming apparatus 1.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

a photosensitive body;

an exposing section which includes a light source that emits a light beam and which scans, in a main scanning direction, the light beam emitted by the light source to render a main scanning line on the photosensitive body;

a pulse generating section which generates a periodic pulse signal;

a smoothing section which smoothes the pulse signal generated by the pulse generating section and generate an analog signal;

a driving-current generating section which generates a driving current for the light source on the basis of the analog signal generated by the smoothing section;

a light-amount storing section which stores, in the main scanning line divided into a plurality of blocks, in advance light amounts of the light beam irradiated on the blocks;

a change-data storing section which stores in advance a plurality of change data items set in a vicinity of each of block boundaries of the plurality of blocks, the plurality of change data items being used to cope with each of a plurality of events that are likely to affect image quality of the vicinity of the block boundary and the plurality of change data items respectively representing changes in a value of the analog signal at time when the blocks on which the light beam is irradiated are switched in the vicinity of the block boundary; and an irradiation control section which selects, out of the plurality of change data items stored in the change-data storing section, change data for coping with an event selected out of the plurality of events and instruct the pulse generating section to generate, (a) in the vicinity of the block boundary, the pulse signal from which the analog signal indicating a change in a value represented by the selected change data is obtained and (b) in the blocks, the pulse signal indicating the light amounts of the light beam irradiated on the blocks stored in the light-amount storing section, wherein, when the event selected out of the plurality of events is a ripple that occurs in the analog signal, in each rendering of the main scanning line, the irradiation control section selects, at random, any one of the plurality of change data items stored in the change-data storing section and instructs the pulse generating section to generate the pulse signal in (a).

2. The image forming apparatus according to claim 1, further comprising:

a BD sensor which receives the light beam emitted from the light source to thereby generate a BD signal set as a reference for starting the rendering of the main scanning line; and a random-number generating section which receives an input of the BD signal and generate a random number every time the BD signal is input, wherein the irradiation control section change data allocated to the random number out of the plurality of change data items stored in the change-data storing section.

3. The image forming apparatus according to claim 1, wherein the pulse generating section generates a PWM signal or a PDM signal as the pulse signal, and the smoothing section is a low-pass filter composed of a capacitor and a resistor.

4. The image forming apparatus according to claim 1, wherein the plurality of change data items include change data for correction for proportionating a change in a light amount of the light beam and a change in density of an image in the vicinity of the block boundary, and when the event selected out of the plurality of events is a development characteristic γ indicating a relation between the change in the light amount of the light beam and the change in the density of the image, the irradiation control section selects the change data for correction out of the plurality of change data items stored in the change-data storing section and instructs the pulse generating section to generate the pulse signal in (a).

5. The image forming apparatus according to claim 1, further comprising a receiving section which receives an input of operation for selecting an event to be coped with out of the plurality of events, wherein the irradiation control section selects, out of the plurality of change data items stored in the change-data storing section, change data for coping with the event, the selection of which is received by the receiving section, and instructs the pulse generating section to generate the pulse signal in (a).

6. The image forming apparatus according to claim 1, wherein the plurality of change data items include first change data in which a gradient of a graph indicating the change in the value of the analog signal is fixed, and when the event selected out of the plurality of events is a sudden change in a light amount of the light beam in the vicinity of the block, in each rendering of the main scanning line, the irradiation control section selects the first change data stored in the change-data storing section and instructs the pulse generating section to generate the pulse signal in (a).

7. The image forming apparatus according to claim 1, wherein the irradiation control section instructs the pulse generating section to switch the pulse signal in (b) to the pulse signal in (a) before a block on which the light beam is irradiated is switched to a next block in each block of the plurality of blocks in order to cause a light amount of the light beam irradiated on the block to reach a light amount of the light beam irradiated on the next block at a point when the block on which the light beam is irradiated is switched to the next block.

8. An image forming apparatus comprising:

a photosensitive body;

an exposing section which includes a light source that emits a light beam and which scans, in a main scanning direction, the light beam emitted by the light source to render a man scanning line on the photosensitive body;

a pulse generating section which generates a periodic pulse signal;

a smoothing section which smoothes the pulse the signal generated by the pulse generating section and generate an analog signal;

a driving-current generating section which generates a drive current for the light source on the basis of the analog signal generated by the smoothing section;

a light-amount storing section which stores, in the main scanning line divided into a plurality of blocks, in advance light amounts of the light beam irradiated on the blocks;

a change data storing section which stores in advance a plurality of change data items set in a vicinity of each block boundaries of the plurality of blocks, the plurality of change data items being used to cope with each of the plurality of events that are likely to affect image quality of the vicinity of the block boundary and the plurality of change data items respectively representing changes in a value of the analog signal at time when the blocks on which the light beam is irradiated are switched in the vicinity of the block boundary; and an irradiation control section which selects, out of the plurality of change data items stored in the change-data storing section, change data for coping with an event selected out of the plurality of events and instruct the pulse generating section to generate, (a) in the vicinity of the block boundary, the pulse signal from which the analog signal indicating a change in a value represented by the selected change data is obtained and (b) in the blocks, the pulse signal indicating the light amounts of the light beam irradiated on the blocks stored in the light-amount storing section, wherein the plurality of change data items include first change data in which a gradient of a graph indicating the change in the value of the analog signal is fixed, second change data in which an initial gradient of the graph is small and increases halfway, third change data in which an initial gradient of the graph is large and decreases halfway, fourth change data in which an initial gradient of the graph is small, increases halfway, and decreases again, and fifth change data in which an initial gradient of the graph is large, decreases halfway, and increases again.

* * * * *